US009181007B2

(12) United States Patent
Forrest et al.

(10) Patent No.: US 9,181,007 B2
(45) Date of Patent: Nov. 10, 2015

(54) BEVERAGE CAN END WITH VENT PORT

(71) Applicant: Rexam Beverage Can Company, Chicago, IL (US)

(72) Inventors: Randall Forrest, Park Ridge, IL (US); Michael Gogola, Itasca, IL (US); Derek Siegal, Chicago, IL (US)

(73) Assignee: Rexam Beverage Can Company, Chicago, IL (US)

( * ) Notice: Subject to any disclaimer, the term of this patent is extended or adjusted under 35 U.S.C. 154(b) by 10 days.

(21) Appl. No.: 13/796,645

(22) Filed: Mar. 12, 2013

(65) Prior Publication Data

US 2014/0263320 A1 Sep. 18, 2014

(51) Int. Cl.

| | |
|---|---|
| ***B65D 17/347*** | (2006.01) |
| ***B65D 51/16*** | (2006.01) |
| ***B65D 17/00*** | (2006.01) |
| *B65D 17/34* | (2006.01) |

(52) U.S. Cl.

CPC ..... *B65D 51/1677* (2013.01); *B65D 17/161* (2013.01); *B65D 17/165* (2013.01); *B65D 2517/0014* (2013.01); *B65D 2517/0092* (2013.01); *B65D 2517/0094* (2013.01)

(58) Field of Classification Search

CPC ..... B65D 17/165; B65D 17/163; B65D 2517/0014; B65D 2517/0077; B65D 2517/0079; B65D 2517/0089; B65D 2517/0049; B65D 2517/0092; B65D 2517/0094

USPC ..... 220/272, 267, 271, 277, 273, 268

See application file for complete search history.

(56) References Cited

U.S. PATENT DOCUMENTS

| | | | |
|---|---|---|---|
| 3,221,924 | A | 12/1965 | Harvey et al. |
| 3,250,425 | A | 5/1966 | Stec et al. |
| 3,441,169 | A | 4/1969 | Dunn et al. |
| 3,485,410 | A | 12/1969 | Boik |
| 3,627,168 | A | 12/1971 | Fraze |
| 4,002,262 | A | 1/1977 | Khoury |
| 4,182,460 | A | 1/1980 | Holk, Jr. et al. |

(Continued)

FOREIGN PATENT DOCUMENTS

| | | | |
|---|---|---|---|
| WO | 2008023983 | A1 | 2/2008 |
| WO | 2011031681 | A1 | 3/2011 |

OTHER PUBLICATIONS

European Patent Office acting as International Searching Authority, International Search Report for Rexam Beverage Can Company PCT Application No. PCT/US2014/024802 mailed Jul. 8, 2014.

*Primary Examiner* — Mickey Yu
*Assistant Examiner* — Niki Eloshway
(74) *Attorney, Agent, or Firm* — Greer Burns & Crain, Ltd.; Peter M. Klobuchar

(57) ABSTRACT

A can end for a beverage container has a center panel with a stay-on tab opening system. A tear panel is defined by a first frangible score and a non-frangible hinge segment. A tab is attached to the center panel by a rivet. The tab has a void region partially surrounding a rivet island. A first circle has a first center point located at a center of the rivet and a first radius equal to a distance from the center of the rivet to a radially outermost point of the void region on a first axis running through the nose and lift ends of the tab and a center of the rivet. A second circle has a coincident center and a second radius less than 2.5 times first radius. A second frangible score is spaced completely radially outwardly from the rivet island and between the first and second circles.

35 Claims, 8 Drawing Sheets

(56) References Cited

U.S. PATENT DOCUMENTS

| | | | | | |
|---|---|---|---|---|---|
| 4,213,538 | A | | 7/1980 | Boardman | |
| 4,386,713 | A | | 6/1983 | Baumeyer et al. | |
| 4,577,777 | A | | 3/1986 | Brochman | |
| 4,674,649 | A | | 6/1987 | Pavely | |
| 4,705,186 | A | | 11/1987 | Barrash | |
| 4,741,451 | A | | 5/1988 | Hobbs | |
| 4,747,511 | A | | 5/1988 | Dutt et al. | |
| 4,762,246 | A | | 8/1988 | Ashley et al. | |
| 4,778,072 | A | | 10/1988 | Newman | |
| 4,815,655 | A | | 3/1989 | Jacobsson et al. | |
| 4,893,725 | A | | 1/1990 | Ball et al. | |
| 4,928,845 | A | | 5/1990 | Doyle | |
| 4,951,836 | A | | 8/1990 | Yoshimura et al. | |
| 4,960,206 | A | | 10/1990 | Johannes | |
| 4,971,218 | A | | 11/1990 | Buchner et al. | |
| 5,011,037 | A | * | 4/1991 | Moen et al. | 220/271 |
| 5,038,956 | A | | 8/1991 | Saunders | |
| 5,052,573 | A | | 10/1991 | Zysset | |
| 5,121,851 | A | | 6/1992 | Lyon et al. | |
| 5,217,134 | A | | 6/1993 | Saunders | |
| 5,244,113 | A | | 9/1993 | Stymiest | |
| 5,285,919 | A | * | 2/1994 | Recchia | 220/271 |
| 5,307,947 | A | | 5/1994 | Moen et al. | |
| D348,176 | S | | 6/1994 | Sokolski et al. | |
| 5,375,729 | A | | 12/1994 | Schubert | |
| 5,397,014 | A | | 3/1995 | Aydt | |
| D365,988 | S | | 1/1996 | Clarke, III | |
| 5,494,184 | A | * | 2/1996 | Noguchi et al. | 220/269 |
| D371,073 | S | | 6/1996 | Taylor | |
| 5,555,992 | A | | 9/1996 | Sedgeley | |
| 5,647,499 | A | | 7/1997 | Piazza | |
| D382,481 | S | | 8/1997 | McEldowney | |
| D387,666 | S | | 12/1997 | Wise | |
| D387,987 | S | | 12/1997 | Neiner | |
| 5,692,636 | A | | 12/1997 | Schubert | |
| 5,695,085 | A | | 12/1997 | Hadener | |
| 5,711,448 | A | | 1/1998 | Clarke, III | |
| 5,713,481 | A | | 2/1998 | Jordan | |
| 5,782,373 | A | | 7/1998 | Bianchi | |
| D396,635 | S | | 8/1998 | McEldowney | |
| 5,819,973 | A | | 10/1998 | Traub, Sr. et al. | |
| 5,860,553 | A | | 1/1999 | Schubert | |
| D406,236 | S | | 3/1999 | Brifcani et al. | |
| 5,883,814 | A | | 3/1999 | Luk et al. | |
| 5,906,288 | A | | 5/1999 | Dwinell | |
| D411,107 | S | | 6/1999 | Turner et al. | |
| 5,934,501 | A | | 8/1999 | Wright et al. | |
| 5,947,316 | A | | 9/1999 | Guillonnet | |
| 5,955,127 | A | | 9/1999 | Glaser | |
| D415,026 | S | | 10/1999 | Turner et al. | |
| D415,425 | S | | 10/1999 | Turner et al. | |
| 5,971,195 | A | | 10/1999 | Reidinger et al. | |
| D416,200 | S | | 11/1999 | Pavely et al. | |
| 5,979,688 | A | | 11/1999 | Stodd | |
| 5,992,677 | A | | 11/1999 | Ebine | |
| 6,015,060 | A | | 1/2000 | Rightenour et al. | |
| 6,024,239 | A | | 2/2000 | Turner et al. | |
| D421,393 | S | | 3/2000 | Pavely et al. | |
| 6,050,440 | A | | 4/2000 | McEldowney | |
| D424,438 | S | | 5/2000 | Turner et al. | |
| 6,065,634 | A | | 5/2000 | Brifcani et al. | |
| 6,079,583 | A | | 6/2000 | Chasteen | |
| D432,015 | S | | 10/2000 | Holiday | |
| 6,126,029 | A | | 10/2000 | Storgaard | |
| 6,129,230 | A | | 10/2000 | Turner et al. | |
| 6,194,011 | B1 | | 2/2001 | Glaser | |
| 6,196,412 | B1 | | 3/2001 | Cattell | |
| 6,202,880 | B1 | | 3/2001 | Strube et al. | |
| 6,206,220 | B1 | | 3/2001 | Stodd | |
| 6,234,336 | B1 | | 5/2001 | Neiner | |
| 6,260,728 | B1 | | 7/2001 | Turner et al. | |
| 6,311,860 | B1 | | 11/2001 | Reidinger et al. | |
| 6,330,955 | B2 | | 12/2001 | Easler, Sr. | |
| 6,354,453 | B1 | | 3/2002 | Chasteen | |
| 6,375,029 | B2 | | 4/2002 | Anthony et al. | |
| 6,405,889 | B1 | | 6/2002 | Neiner | |
| 6,408,498 | B1 | | 6/2002 | Fields et al. | |
| 6,591,999 | B1 | | 7/2003 | Molin et al. | |
| 6,604,647 | B1 | | 8/2003 | Luburic | |
| 6,662,959 | B1 | | 12/2003 | Westerhold | |
| 6,715,629 | B2 | | 4/2004 | Hartman et al. | |
| 6,761,281 | B2 | | 7/2004 | Hartman | |
| 6,789,692 | B2 | | 9/2004 | Prezelin | |
| D499,651 | S | | 12/2004 | Gong | |
| 6,848,875 | B2 | | 2/2005 | Brifcani et al. | |
| 6,877,941 | B2 | | 4/2005 | Brifcani et al. | |
| 6,889,861 | B2 | | 5/2005 | Arcati et al. | |
| 6,889,862 | B2 | | 5/2005 | Vaughan | |
| 6,935,826 | B2 | | 8/2005 | Brifcani et al. | |
| 6,951,293 | B2 | | 10/2005 | Thibaut | |
| 6,981,608 | B2 | | 1/2006 | Battmer | |
| 7,000,797 | B2 | | 2/2006 | Forrest et al. | |
| 7,100,789 | B2 | | 9/2006 | Nguyen et al. | |
| 7,107,783 | B2 | | 9/2006 | Smolko et al. | |
| 7,165,696 | B2 | | 1/2007 | Neiner | |
| 7,165,926 | B2 | | 1/2007 | Rieck et al. | |
| D559,680 | S | | 1/2008 | Jacober et al. | |
| D569,271 | S | | 5/2008 | Gowans et al. | |
| 7,380,684 | B2 | | 6/2008 | Reed et al. | |
| 7,384,227 | B2 | | 6/2008 | Rieck et al. | |
| 7,500,376 | B2 | | 3/2009 | Bathurst et al. | |
| 7,506,779 | B2 | | 3/2009 | Jentzsch et al. | |
| 7,513,383 | B2 | | 4/2009 | Hwang | |
| 7,617,945 | B2 | | 11/2009 | Cherian | |
| 7,673,768 | B2 | | 3/2010 | Reed et al. | |
| 7,721,906 | B2 | | 5/2010 | Heinicke | |
| 7,743,635 | B2 | | 6/2010 | Jentzsch et al. | |
| 7,748,557 | B2 | | 7/2010 | Robinson | |
| 7,891,519 | B2 | | 2/2011 | Matsukawa et al. | |
| 7,900,796 | B2 | | 3/2011 | Ungrady et al. | |
| 7,909,196 | B2 | | 3/2011 | Turner et al. | |
| 7,922,025 | B2 | | 4/2011 | Heinicke | |
| 7,926,675 | B2 | | 4/2011 | Rieck et al. | |
| D637,489 | S | | 5/2011 | Petlak et al. | |
| D638,704 | S | | 5/2011 | Petlak et al. | |
| 7,938,290 | B2 | | 5/2011 | Bulso | |
| 7,942,285 | B2 | | 5/2011 | Hasegawa et al. | |
| 7,975,884 | B2 | | 7/2011 | Mathabel et al. | |
| 8,109,405 | B2 | | 2/2012 | Butcher et al. | |
| 8,113,375 | B2 | | 2/2012 | Jeon | |
| 8,177,092 | B2 | | 5/2012 | Mills | |
| 8,186,532 | B2 | | 5/2012 | Shinguryo et al. | |
| 8,573,432 | B2 | * | 11/2013 | Emanuele et al. | 220/271 |
| 2003/0080132 | A1 | | 5/2003 | Forrest et al. | |
| 2010/0018976 | A1 | * | 1/2010 | Christian et al. | 220/268 |
| 2010/0294771 | A1 | | 11/2010 | Holder et al. | |
| 2011/0056946 | A1 | * | 3/2011 | Emanuele et al. | 220/271 |
| 2011/0266281 | A1 | * | 11/2011 | Thiemann et al. | 220/271 |
| 2012/0031056 | A1 | | 2/2012 | Chasteen et al. | |
| 2012/0048870 | A1 | | 3/2012 | Ellerbe, III et al. | |
| 2012/0260613 | A1 | * | 10/2012 | Holder et al. | 53/492 |

* cited by examiner

BEVERAGE CAN END WITH VENT PORT

CROSS-REFERENCE TO RELATED APPLICATIONS

N/A

FEDERALLY SPONSORED RESEARCH OR DEVELOPMENT

N/A

TECHNICAL FIELD

The invention relates to beverage containers having a stay-on tab opening system; more particularly, the invention relates to a pressure equalization port for improving the pourability of a beverage from the beverage container.

BACKGROUND OF THE INVENTION

Typical end closures for beer and beverage containers have an opening panel and an attached leverage tab for pushing the opening panel into the container to open the end. The container is typically a drawn and ironed metal can, usually constructed from a thin plate of aluminum. End closures for such containers are also typically constructed from a cutedge of thin plate of aluminum or steel, formed into a blank end, and manufactured into a finished end by a process often referred to as end conversion. These ends are formed in the process of first forming a cutedge of thin metal, forming a blank end from the cutedge, and converting the blank into an end closure which may be seamed onto a container.

These types of container ends have been used for many years, with almost all such ends in use today being the "ecology" or "stay-on-tab" ("SOT") ends in which the tab remains attached to the end after a tear panel, including large-opening ends ("LOE"), is opened. The tear panel being a portion of the can end defined by a score length. The tear panel may be opened, that is the score may be severed, and the tear panel displaced at an angular orientation relative to the remaining portion of the can end, thus creating a pour opening through which the beverage may be poured from the container. The tear panel remains hingeably connected to the remaining portion of the can end by a hinge segment, leaving an opening through which the user draws the contents of the container. In an LOE, the pour opening is about 0.5 square inches in area.

Opening of the tear panel is operated by the tab which is attached to the can end by a rivet through a rivet island on the tab. The tab is attached to the can end such that a nose of the tab extends over a proximal portion of the tear panel. A lift end of the tab is located opposite the tab nose and provides access for a user to lift the lift end, such as with the user's finger, to force the nose against the proximal portion of the tear panel.

When the tab nose is forced against the tear panel, the score initially ruptures at a vent region of the score. This initial rupture of the score is primarily caused by the lifting force on the tab resulting in lifting of a central region of the can end, immediately adjacent the rivet. As the tab is lifted further, the score rupture propagates along the length of the score, eventually stopping at the hinge segment.

Because ends are used for containers with pressurized contents and/or contents that require heat treatment or pasteurization, the score of the opening panel must have sufficient score residual to withstand such pressure, which in turn requires that the tab have a thickness of metal to provide strength to open the panel. The tab must have a thickness that imparts strength for opening the end member, and which provides reliability for opening the tear panel opening of the end member.

One problem associated with these opening systems is pourability of the beverage from the container. Because these ends are not typically outfitted with a pressure equalization aperture, the beverage may "glug" as air enters the beverage container through the pour opening to replace the volume of the quickly exiting beverage emptied from the container. "Glug" refers to an uneven flow caused by the outside air attempting to enter the container through the pour opening.

Many years ago, prior to beverage containers having a frangible tear panel of any sort, users opened beverage containers with church keys having a downturned sharpened beak used to pierce the end closure. The user would pierce the end closure twice creating a pour opening and an equalization opening. This method is often used today by beverage vendors at sporting stadiums and the like where speed of beverage delivery is important to serve many customers in short periods of time. Many efforts have been made to outfit SOT ends with some sort of equalization opening. None of these attempts have been universally adopted due in no small part to the significant drawbacks associated with each one.

For example, one method of improving pourability of SOT end closures involves enlarging the pour opening. However, the openings can rarely be made large enough to fully eliminate glugging. Additionally, when the openings are made very large, unwanted spillage becomes an issue from splashing, spewing, or spitting of the beverage through the very large pour opening. Moreover, the larger pour opening typically requires rotation of the tab about the rivet to apply tab nose forces in a plurality of locations on the closure to bend an enlarged tear panel into the container. Fully flexing a hinge region on the tab several times results in work hardening of the rivet island causing the metal to become brittle which could result in the tab undesirably breaking free from the closure. Also, the user must rotate the tab to a precise location without instruction in order for the tear panel to produce the larger pour opening.

Some designers have proposed providing a second tear panel in the end closure. These designs generally rely on use of an external puncturing tool, e.g. the church key, or using the SOT to open the second tear panel. Obviously requiring the user to supply an external puncturing tool is undesirable as it represents devolving of the art to the days of the church key. Using the SOT to open the second tear panel requires the rotating and flexing of the SOT described above which shares the drawbacks of the larger opening ends also described above. Finally, the size and location of these second tear panels are undesirable because the openings are too large resulting in spillage and/or too close to pour opening to create a sufficient pourability advantage.

One proposed method of eliminating rotation of the tab to open an equalization port requires providing a rocking tab or "teeter tauter" tab wherein one end of the tab is used to open the pour panel while the opposite end or some other portion of the tab is used to open the equalization port. However, rocking of the tab is undesirable because it could result in premature opening of one or both of the tear panels.

Efforts have placed such a vent feature close to or under the rivet island of the SOT and/or within a coined region surrounding the rivet. These features consist of a second frangible score that is fractured when the SOT is lifted to fracture the frangible score which partially defines the pour opening. These locations and methods are undesirable because they are located too close to the pour opening which could lead to unwanted spillage through the vent, and the method of severing does not provide the user with the option of using or not using the vent because the second score is automatically or naturally severed when the user fractures the main score partially defining the pour opening.

Another recent attempt at providing improved pour includes forming a deboss channel at approximately a 1 o'clock position of the pour opening. There is some debate whether the deboss channel provides any improvement in pourability.

Thus, the problems associated with prior attempts to provide a pressure equalization port primarily center on the size and/or location of the port and/or method of opening. A non-exhaustive list of problems associated with these prior attempts includes the following singularly and in any combination: not providing the user an option of using/opening the port due to location, undesirably and/or unnecessarily too large, located too close to the dispensing opening, requires use of an enteral tool such as a church key, requires use of a user's finger to push down on the center panel in direct engagement therewith which could cause cuts on the user's finger due to sharp edges on the center panel, possible premature opening of the port, unacceptable/nonexistent pressure equalization within the container, and spills and splashes of the contents of the container. As is explained in greater detail below, the present invention reduces or eliminates these problems with container ends. The present invention provides variations for overcoming the specific difficulties associated with design, manufacture and use of large-open beverage container ends.

The present invention is provided to solve the problems discussed above and other problems, and to provide advantages and aspects not provided by prior end closures of this type. A full discussion of the features and advantages of the present invention is deferred to the following detailed description, which proceeds with reference to the accompanying drawings.

SUMMARY OF THE INVENTION

A first aspect of the present invention is directed to a can end for closing an open end of a two-piece or three-piece beverage container. A circumferential curl is centered about a longitudinal axis. A circumferential wall extends downwardly relative to the curl. A circumferential strengthening member extends radially inwardly from the circumferential wall relative to the longitudinal axis. A center panel, about which the circumferential strengthening member extends, has a public side opposite a product side. The center panel comprises a peripheral edge defining a radially outer perimeter of the center panel. A tear panel is spaced radially inwardly from the peripheral edge. The tear panel is defined by a first frangible score in the public side and non-frangible hinge segment. A tab is attached to the center panel by a rivet of the center panel. The tab has a lift end and a nose end opposite the lift end. The nose end overlies the tear panel in a first frangible score breaking position. A rivet island of the tab has a rivet aperture. A void region partially surrounding the rivet island and having a first leg extending along a first side of the rivet island and a second leg extending along a second side of the rivet island. A tab hinge extends between respective terminal ends of the first and second legs of the void region. A coined portion of the center panel surrounds the rivet. The center panel has a first axis which extends through the nose end and lift end of the tab and through a center of the rivet. A second axis is perpendicular to the first axis. A first circle has a first center point located at the center of the rivet and a first radius equal to a distance from the center of the rivet to a radially outermost point of the void region on the first axis. A second circle has a second center point located at the center of the rivet and a second radius less than 2.5 times the first radius. A second frangible score is spaced completely radially outwardly from the rivet island and between the first circle and the second circle.

The first aspect of the invention may include one or more of the following additional features, alone or in any reasonable combination. The can end may further comprise a third circle having a third radius equal to a maximum length from the center of the rivet to the nose end of the tab wherein the second frangible score intersects the third circle. The can end may further comprise a third circle having a third radius equal to a maximum length from the center of the rivet to the nose end of the tab wherein the second frangible score is located between and spaced from the second circle and the third circle. The can end may further comprise a third circle having a third radius equal to a maximum length from the center of the rivet to the nose end of the tab wherein the second frangible score is located between the first circle and the second circle. The second frangible score may be spaced from the first circle and the second circle. The tab may have a perimeter defining a tab area therebetween and the second frangible score may be located within a region of the center panel under the tab area when the tab is in the first frangible score breaking position. The tab may have a peripheral edge defining a tab area and the second frangible score may be located entirely within a region of the center panel under the tab area when the tab is in the first frangible score breaking position. The tab nose may be rotatable about the rivet 180 degrees from the first frangible score breaking position such that the tab nose overlies the second frangible score. The tab nose may be rotatable about the rivet 180 degrees from the first frangible score breaking position such that the first axis bisects the tab nose and the tab nose is located radially inwardly of the second frangible score. The tab nose may be rotatable about the rivet 180 degrees from the first frangible score breaking position such that the first axis bisects the tab nose and the tab nose is located radially outwardly of the second frangible score. The first axis may bisect the second frangible score. The second frangible score may have a curvilinear shape having a pair of concave portions between opposing terminal ends and separated by a convex portion relative to each other. The tab may comprise a second void region defining a finger hole and wherein the second frangible score is visible through the finger hole. The first and second axes may lie along diametrical lines on the center panel. The can end may further comprise a deboss panel recessed within the center panel wherein the tab and the first and second frangible scores are located entirely within the deboss panel. The can end may further comprise an upwardly extending bead of the center panel partially surrounding the coined portion surrounding the rivet located between the second frangible score and the rivet.

A second aspect of the present invention is directed to a can end for closing an open end of a two-piece or three-piece beverage container. A circumferential curl is centered about a longitudinal axis. A circumferential wall extends downwardly relative to the curl. A circumferential strengthening member extends radially inwardly from the circumferential wall relative to the longitudinal axis. A center panel, about which the circumferential strengthening member extends, has a public side opposite a product side. The center panel comprises a peripheral edge defining a radially outer perimeter of the center panel. A tear panel is spaced radially inwardly from the peripheral edge. The tear panel is defined by a first frangible score in the public side and non-frangible hinge segment. A tab is attached to the center panel by a rivet of the center panel. The tab has a lift end and a nose end opposite the lift end. The nose end overlies the tear panel in a first frangible score breaking position. A rivet island of the tab has a rivet aperture. A void region partially surrounding the rivet island and having a first leg extending along a first side of the rivet island and a second leg extending along a second side of the rivet island. A tab hinge extends between respective terminal ends of the first and second legs of the void region. A coined portion of the center panel surrounds the rivet. The center panel has a first axis which extends through the nose end and lift end of the tab and through a center of the rivet. A second axis is perpendicular to the first axis. A selectively openable pressure equalization port is spaced completely radially outwardly from the rivet island and is defined by an area of the center panel located between an edge portion of a broken second frangible score and a plurality of hinge portions located between terminal ends of the second frangible score and opposite the edge portion.

The second aspect of the invention may include one or more of the additional features of the first aspect of the invention, alone or in any reasonable combination and any of the following additional features under the same guidelines. The can end may further comprise a first circle having a first center point located at a center of the rivet and a first radius equal to a distance from the center of the rivet to a radially outermost point of the void region on the first axis. The can end may further comprise a second circle having a second center point located at the center of the rivet and a second radius less than 2.5 times the first radius, wherein the second frangible score is located between the first circle and the second circle.

A third aspect of the present invention is directed to a can end for closing an open end of a two-piece or three-piece beverage container. A circumferential curl is centered about a longitudinal axis. A circumferential wall extends downwardly relative to the curl. A circumferential strengthening member extends radially inwardly from the circumferential wall relative to the longitudinal axis. A center panel, about which the circumferential strengthening member extends, has a public side opposite a product side. The center panel comprises a peripheral edge defining a radially outer perimeter of the center panel. A tear panel is spaced radially inwardly from the peripheral edge. The tear panel is defined by a first frangible score in the public side and non-frangible hinge segment. A tab is attached to the center panel by a rivet of the center panel. The tab has a lift end and a nose end opposite the lift end. The nose end overlies the tear panel in a first frangible score breaking position. A rivet island of the tab has a rivet aperture. A void region partially surrounding the rivet island and having a first leg extending along a first side of the rivet island and a second leg extending along a second side of the rivet island. A tab hinge extends between respective terminal ends of the first and second legs of the void region. A coined portion of the center panel surrounds the rivet. A second frangible score is spaced completely radially outwardly from the rivet island and is intersected by a first diametrical axis passing through a center of the rivet wherein a second diametrical axis passing through the center of the rivet is positioned at a 90 degree angle to the first diametrical axis and wherein opposing terminal ends of the second frangible score are located on opposing sides of the first diametrical axis and a length of the second frangible score between the terminal ends is greater than a distance between a radially outermost portion of the second frangible score to a radially innermost portion of the second frangible score.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
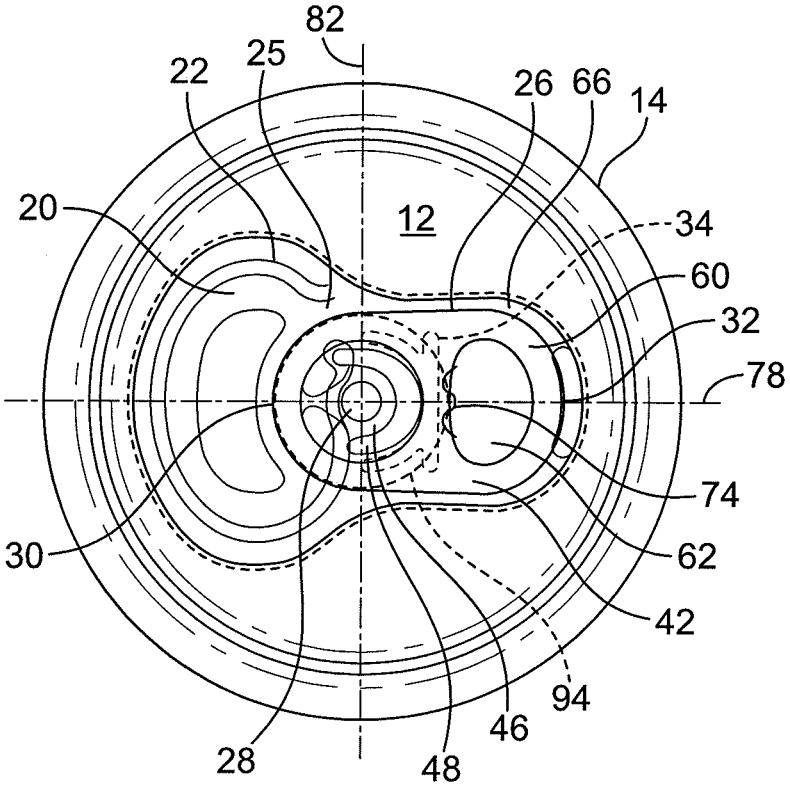
FIG. 1 is a top view of a can end of the present invention showing a curvilinear score acting as a means for providing a pressure equalization port when severed or fractured.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention provides a can end aimed at providing a suitable pressure equalization port which allows a volume of fluid to enter a head space above a beverage within a beverage container. This allows the beverage to pour more smoothly and rapidly through a dispensing opening in the can end. The pressure equalization port allows the fluid to enter the head space to replace the volume of the quickly exiting liquid beverage emptied from the container through a dispensing opening. The present invention is directed to a means for providing a selectively openable pressure equalization port. The pressure equalization port of the present invention is intended to overcome the drawbacks of such prior pressure equalization ports. More specifically, the pressure equalization port of the present invention is sized to overcome the overly large pressure equalization ports in the prior art. It is selectively openable rather than automatically openable. It is located a sufficient distance away from the dispensing port to avoid spillage. It is operable/openable by a tab already attached to the can end, and it is much less likely to be inadvertently and undesirably opened during transit or handling. Finally, it cannot be debated whether the pressure equalization port provides an improvement in pourability of the beverage from the beverage container.

Referring generally to the figures, a beverage can end 10 for a container has a center panel 12 separated from a seaming curl 14 by a circumferential wall 15 extending downwardly from the seaming curl 14 to a strengthening member 16 which is joined to the center panel 12. The container is typically a drawn and ironed metal can, usually constructed from a thin plate of aluminum or steel. Beverage can ends for such containers are also typically constructed from a cutedge of a thin plate of aluminum or steel, formed into a blank end, and manufactured into a finished end by a process often referred to as end conversion.

The can end 10 can be joined to a container by the seaming curl 14 which is joined to a mating curl of the container. The seaming curl 14 of the can end 10 is integral with the center panel 12 by the circumferential wall 15 and a strengthening member 16, typically either a countersink or a fold, which is joined to a peripheral edge 18 of the center panel 12, defining an outer perimeter of the center panel 12, often through an additional strengthening feature such as a circumferential step or other circumferential wall. This type of means for joining the center panel 12 to a container is presently the typical means for joining used in the industry, and the structure described above is formed in the process of forming the blank end from a cutedge of metal plate, prior to the end conversion process. However, other means for joining the center panel to a container may be employed with the present invention.

The steps of manufacturing the end begin with blanking the cutedge, typically a round or non-round cutedge of thin metal plate. Examples of non-round cutedge blanks include elliptical cutedges, convoluted cutedges, and harmonic cutedges. A convoluted cutedge may be described as generally having three distinct diameters, each diameter being 45° relative to the others. The cutedge is then formed into a blank end by forming the seaming curl, countersink, panel radius and the center panel.

The conversion process for this type of beverage can end includes the following steps: forming a rivet by first forming a projecting bubble in the center of the panel and subsequently working the metal of the bubble into a button and into the more narrow projection of metal; forming the tear panel by scoring the metal of the panel wall; forming an inner bead or panel on the tear panel; forming a deboss panel by bending the metal of the panel wall such that a central area of the panel wall is slightly lower than the remaining panel wall; staking the tab to the rivet; and other subsequent operations such as wipe-down steps to remove sharp edges of the tab, lettering on the panel wall by scoring, incising, or embossing (or debossing), and restriking the rivet island.

The seaming curl 14 defines an outer perimeter of the beverage can end 10. It is generally centered about a longitudinal or vertical axis 50.

The center panel 12 has a displaceable tear panel 20 defined by a frangible score 22 and a non-frangible hinge segment 25. The tear panel 20 of the center panel 12 may be opened, that is the frangible score 22 may be severed and the tear panel 20 displaced at an angular orientation relative to the remaining portion of the center panel 12, while the tear panel 20 remains hingeably connected to the center panel 12 through the hinge segment, to define a dispensing port or pour opening. In this opening operation, the tear panel 20 is displaced at an angular deflection. More specifically, the tear panel 20 is deflected at an angle relative to the plane of the panel 12, with the vortex of the angular displacement being the hinge segment 25.

The tear panel 20 is formed during the conversion process by a scoring operation. The tools for scoring the tear panel 20 in the center panel 12 include an upper die on the public side having a scoring knife edge in the shape of the tear panel 20, and a lower die on the product side to support the metal in the regions being scored. When the upper and lower dies are brought together, the metal of the panel wall 12 is scored between the dies. This results in the scoring knife edge being embedded into the metal of the panel wall 12, forming the score which appears as a wedge-shaped recess in the metal. The metal remaining below the wedge-shaped recess is the residual of the score 22. Therefore, the score is formed by the scoring knife edge causing movement of metal, such that the imprint of the scoring knife edge is made in the public side of the panel wall 12.

The center panel 12 has a public side and an opposing product side and further includes a tab 26. The tab 26 has a generally elongated body along a diametrical line 78 extending through the tab nose 30, a central webbing 42 and the lift end 32. Typical prior art container ends often have a tab 26 which is staked in the final steps of the conversion process by staking the area of the center panel 12 adjacent and under the rivet island 46 at an angle, to bias the tab 26 such that the lift end 32 of the tab 26 rests close to the center panel 12. The center panel 12 may also have a recess near the lift end 32 of the tab 26 to allow for easier finger access.

The figures represent only one example of the rivet island 46 configuration. However, those individuals who are ordinarily skilled in the art would understand that the rivet island 46 and the void region 48 can take any number of shapes without departing from the spirit of the invention, including but not limited to all notch or lance type rivet islands.

The opening of the tear panel 20 is operated by the tab 26 which is attached to the center panel 12 by a rivet 28 spaced from the tear panel 20, generally through a rivet aperture in the rivet island 46. The tab 26 is attached to the center panel 12 such that the nose 30 of the tab 26 extends over a proximal portion of the tear panel 20 in a tear panel 20 or frangible score 22 breaking position. The lift end 32 of the tab 26 is located opposite the tab nose 30 and provides access for a user to lift the lift end 32, such as with the user's finger, to force the nose 30 against the proximal portion of the tear panel 20.

Alternatively, the tab 26 may be attached to the center panel 12 by an adhesive.

The rivet 28 is surrounded by a circular coined region of the center panel 12. The coined region is a compressed portion of the center panel 12 through which the score 22 generally travels. A raised, curvilinear bead 34 may be located about the coined region so that it partially surrounds the coined region.

According to an opening sequence, the tab nose 30 is forced against the tear panel 20, and the score 22 initially ruptures at the vent region of the score 22 of the tear panel 20. This initial rupture of the score 22 is primarily caused by the lifting force on the tab resulting in lifting of a central region of the center panel, immediately adjacent the rivet 28, which causes separation of the residual metal of the score 22. The force required to rupture the score in the vent region, typically referred to as the "pop" force, is a lower degree of force relative to the force required to propagate other regions of the score 22 by continued lifting of the lift end 32 of the tab 26. Therefore, it is preferable for the panel 12 in the area around the rivet 28 to only lift enough to assist with initial score rupture, or "pop," and remains substantially stiff and flat to provide the needed leverage for the tab 26 to propagate the scoreline of the tear panel 20. The present invention provides such optimal stiffness in the center panel, as is explained further below.

After the initial "pop", or venting of the tear panel, the user continues to lift the lift end 32 of the tab 26 which causes the tab nose 30 to be pushed downward on the tear panel 20 to continue the rupture of the score 22, as an opening force. As the opening operation is continued, the tear panel 20 is displaced downward and is rotated about the hinge region to be deflected into the container.

The tab 26 has a central webbing 42 located between the nose 30 and the lift end 32. The central webbing 42 includes a hinge region and a rivet island 46 surrounding the rivet 28. An opening or void region 48 of the tab webbing 42 provides an exposed area of the center panel 12. The void region 48 has a curvilinear geometry which borders the rivet island 46 and at least partially surrounds the rivet 28, with a first leg of the void region 48 being disposed generally to one side of the rivet 28, and a second leg being generally disposed on an opposite side of the rivet 28. The hinge region of the tab webbing 42 includes a hinge line which is defined by a substantially straight line passing between a terminal end of the first leg and a terminal end of the second leg of the void region 48. It may also be necessary to add material to the tab webbing 42, modify the radius of the curl, add beading, or other strengthening means to ensure that this area is strong enough wherein the tab 26 bends at the hinge region during opening.

The void region 48 is within the tab webbing 42. The void region 48 may have a generally arch-shaped configuration. In this configuration, the rivet island 46 again follows the general shape of the void region 48.

The hinge region of the tab 26 may be adapted to have a hinge line which is not perpendicular to an axis coincident with the diametrical line. Rather, the hinge line intersects the first axis at an oblique angle. Thus, one embodiment of the present invention has a void region 48 with a first leg which is closer to an outer edge of the tab nose 30, and closer to the tear panel 20, than the second leg. Thus, the hinge line of the tab 26 is oriented at an oblique angle relative to the diametrical line, as it is neither parallel nor perpendicular to the diametrical line.

The alteration of the hinge line orientation relative to the first axis results in a structure which directs the path of the tab 26 during opening of the tear panel 20, caused by lifting force on the lift end 32 to rotate the tab 26 about the hinge line and cause angular displacement of the tab body.

The tab 26 also has a curled portion 54 about a perimeter. The curled portion 54 strengthens the tab 26 and also hides any sharp edges. The curled portion 54 is generally about the entire perimeter of the tab 26 with slit portions to accommodate the rounded contour of the tab 26 and avoid wrinkling of the metal of the tab 26. The curled portion 54 is at least formed from the terminal end of the first leg to the terminal end of the second leg of the void region 48 through the nose end 30. The curled portion 54 comprises metal from the tab rolled downwardly.

Figure 13:
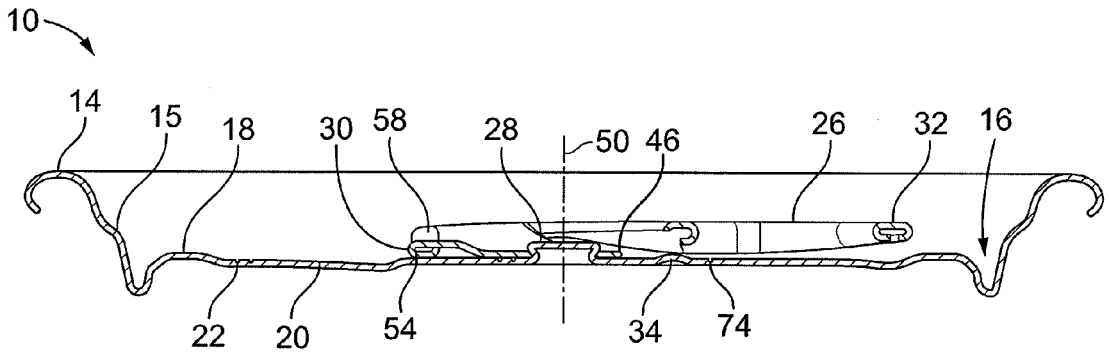
FIG. 13 is a cross-sectional view of a can end having a curvilinear score acting as a means for providing a pressure equalization port.
Figure 14:
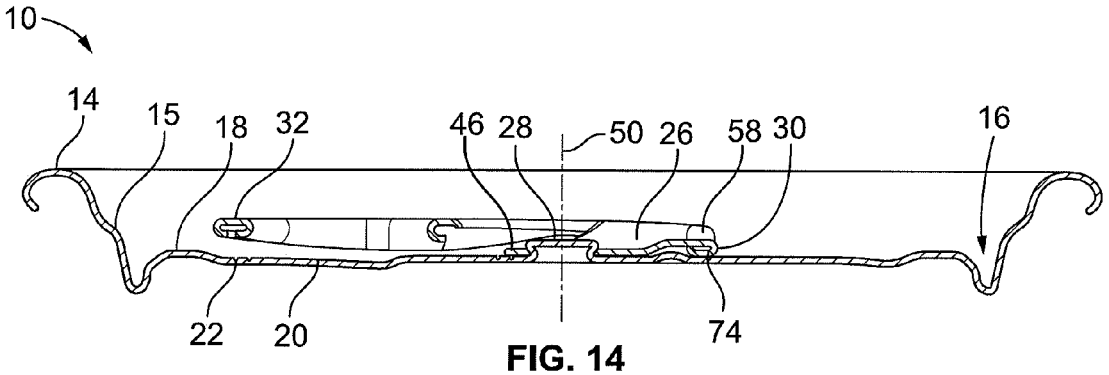
FIG. 14 is a cross-sectional view of a can end having a curvilinear score acting as a means for providing a pressure equalization port with the tab rotated 180 degrees.
Figure 15:
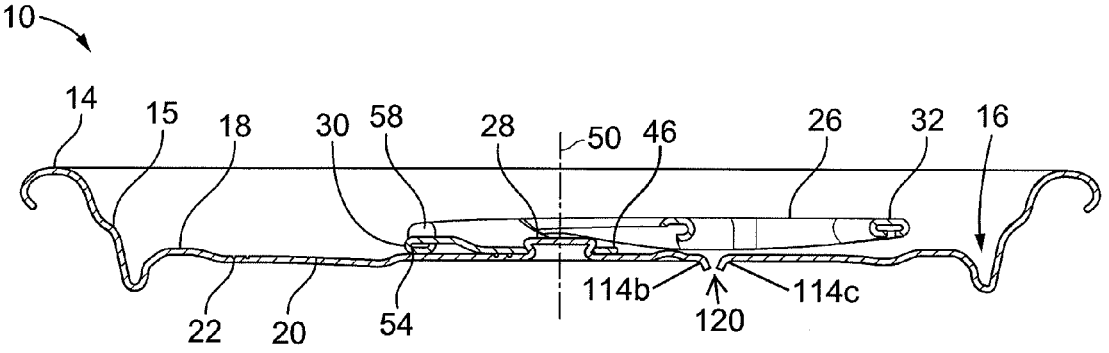
FIG. 15 is a cross-sectional view of a can end of the present invention showing the curvilinear score severed to provide a pressure equalization port as described herein.
Figure 16:
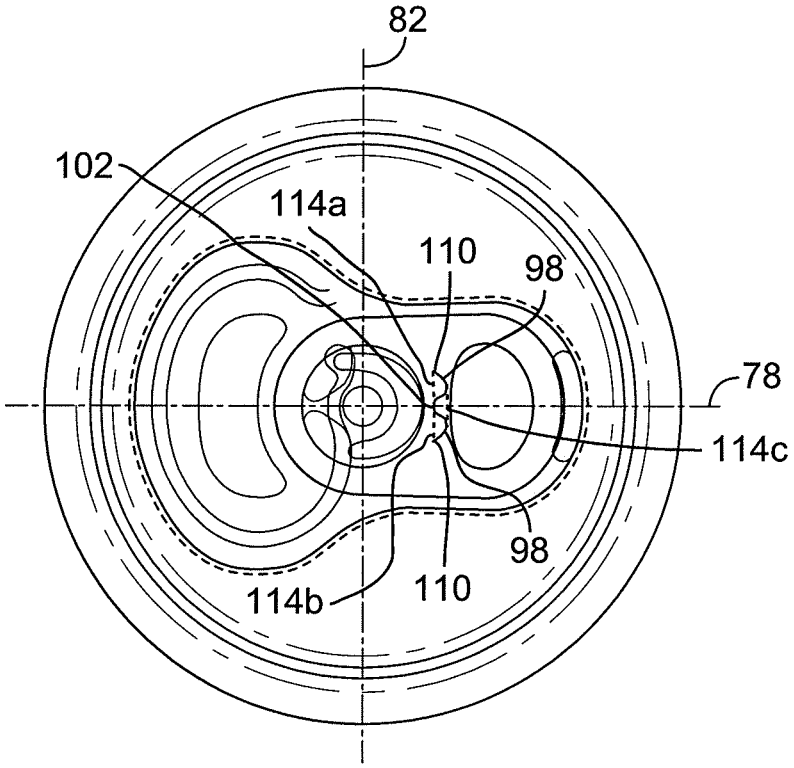
FIG. 16 is a top view of a can end showing the curvilinear score.
Figure 17:
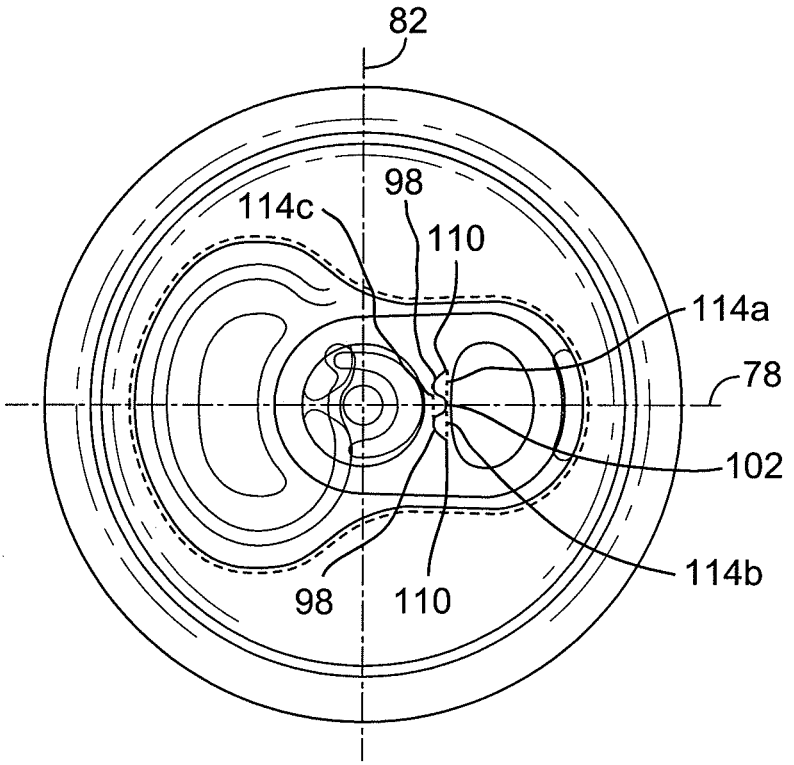
FIG. 17 is a top view of a can end showing the curvilinear score.

To enhance openability of the can end 10, a feature may be added to the nose end 30 of the tab 26. This feature is a cleat 58 as shown in FIGS. 13-15 and described in detail in co-pending and commonly assigned patent application Ser. No. 13/495,369 which is hereby incorporated by reference as if fully set forth herein. The cleat 58 is generally located near the nose end 30 of the tab 26, preferably within ±10° of a first axis as described below, more preferably intersecting the first axis, and most preferably bisected by the first axis. One of ordinary skill in the art would readily appreciate that the cleat 58 can be applied to any of the embodiments disclosed herein.

Structurally, the cleat 58 comprises a compressed portion of the curled portion 54 and substantially V-shaped crevice or U-shaped on an upper surface of the tab 26. The crevice comprises a first wall separated from a second wall by a bottom point. The first and second walls are angled from a vertical plane intersecting the bottom point at an angle between 5° and 35°. While the bottom of the crevice is referred to as the bottom point, it comprises a curved segment with a radius of curvature, rather than a sharp point with a very, very small radius of curvature.

The cleat 58 is formed by striking the upper surface of the tab 26. This compresses the curled portion 54 at the upper surface and forces a bottom surface of the tab 26 downwardly. Thus, a compressed portion of the curled portion 54 extends downwardly towards the public side of the center panel 12 a greater distance than a portion of the curled portion 54 directly adjacent the compressed portion of the curled portion 54.

Thus, the cleat 58 has an upper surface exhibiting a crevice and a lower surface extending downwardly towards the public side of the tear panel 20. The lower surface of the cleat 58 differs structurally from the upper surface. The lower surface forms a bow-shape transverse to first axis rather than a V-shape exhibited by the upper surface. This structural characteristic also reduces an angle between a bottom surface of the tab 26 and the public side of the center panel 12, creating quicker contact between the tab 26 and the tear panel 20 during opening and reducing some rocking of the tab 26 on the rivet 28.

The webbing 42 further comprises a grab portion 60. The grab portion 60 is adapted for user manipulation. Typically, the grab portion 60 includes a finger hole 62 or the like. The finger hole 62 is separated from the void region 48 by a thin segment of the webbing 42, under which the raised bead 34 lies.

A deboss panel 66 is formed in the public side of the central panel 12. The deboss panel 66 is formed in the central panel 12 using conventional die-forming techniques. The tab 26 and the tear panel 20 are typically fully recessed within the deboss panel 66.

According to the present invention, the center panel 12 has a selectively openable pressure equalization port 120. The pressure equalization port 120 is formed by severing a frangible score 74 located a radial distance from a center point of the rivet 28, generally at the intersection of a first axis 78 and a second axis 82. The frangible score 74 is preferably broken by a force caused by lifting the lift end 32 of the tab 26 to force the tab nose 30 downwardly against the center panel 12. The tab 26 is generally rotated about the rivet 28 after opening the tear panel 20, from the tear panel 20 breaking position to a second frangible score 74 breaking position wherein the tab nose 30 is placed adjacent to or directly on the frangible score 74. The cleat 58 will penetrate the frangible score 74 better than a tab without a cleat 58. With a round nose tab, the nose may slide back along the center panel 12.

The first axis 78 extends through the nose end 30 and lift end 32 of the tab 26 and through the center of the rivet 28, generally bisecting a tab of bilateral symmetry. Thus, the first axis 78 may have a length equal to a diameter of the can end 10, assuming a round can end 10. Therefore, in one embodiment the first axis 78 is a diametrical axis.

The second axis 82 is perpendicular to the first axis 78. It may also pass through the center point of the rivet 28. Therefore, it too may be a diametrical axis.

Figure 5:
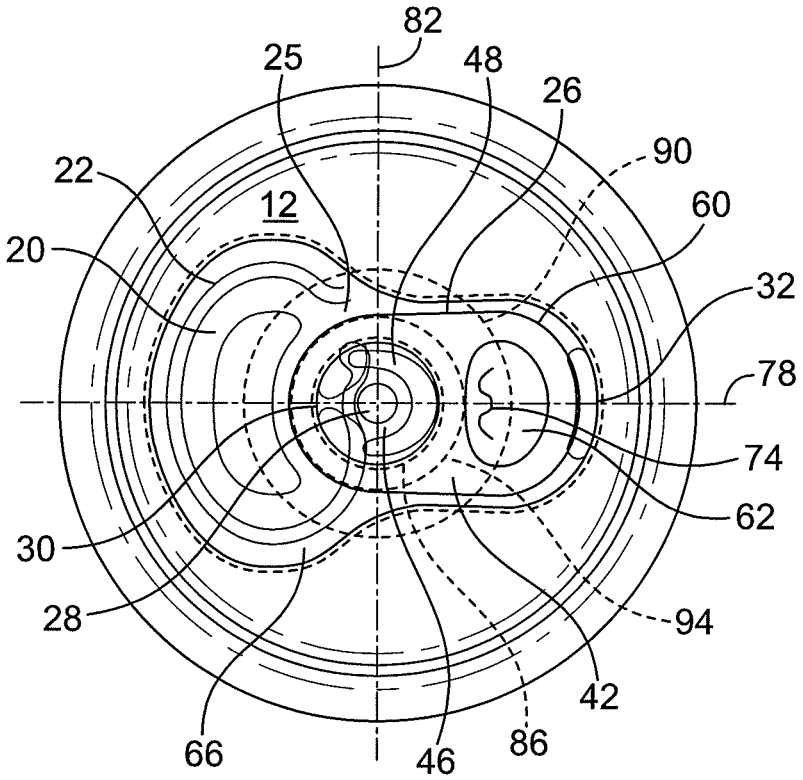
FIG. 5 is a top view of a can end of the present invention showing a curvilinear score acting as a means for providing a pressure equalization port when severed or fractured.
Figure 6:
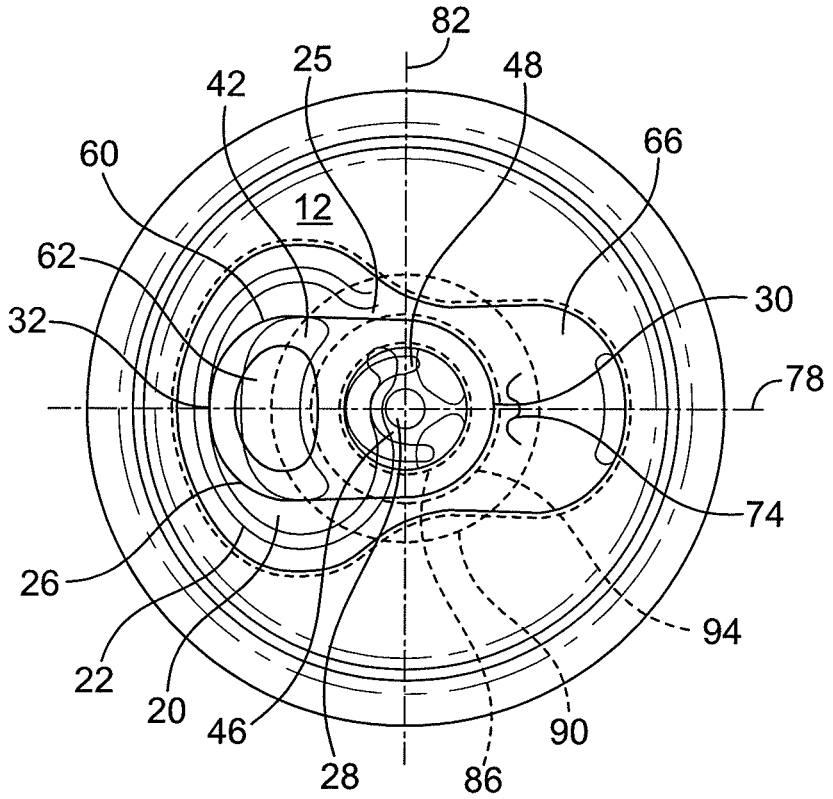
FIG. 6 is a top view of the can end of FIG. 5 showing a tab rotated 180 degrees from a first frangible score breaking position to a second frangible score breaking position.
Figure 7:
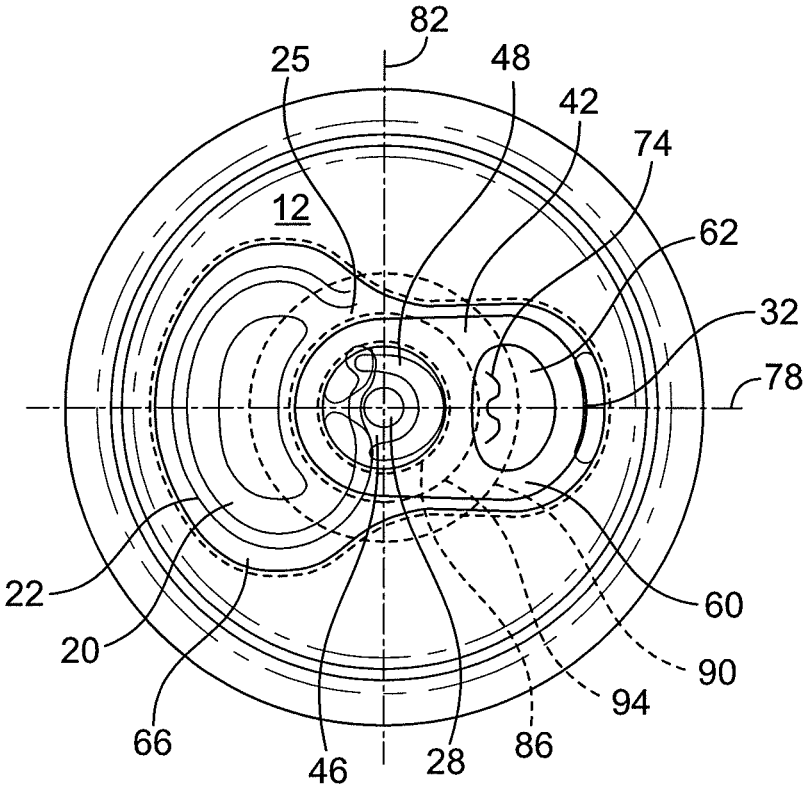
FIG. 7 is a top view of a can end of the present invention showing a curvilinear score acting as a means for providing a pressure equalization port when severed or fractured.

The frangible score 74 is located completely radially outwardly from the rivet island 46 and between a first radial distance 86 from the center of the rivet 28 and a second radial distance 90 from the center of the rivet 28. The first radial distance 86 is equal to a distance from the center of the rivet 28 to a radially outermost point of the void region 48 on the first axis 78, such that the can end 10 has a first circle having a radius equal to the radial distance 86. The second radial distance 90 is greater than but less than 2.5 times the length of the first radial distance 86, such that the can end 10 has a second circle having a radius equal to the second radial distance 90. The frangible score 74 is preferably spaced from the first and second circles such that no portion of the first and second circles intersect the frangible score 74 (see, e.g., FIGS. 5 and 6).

Figure 2:
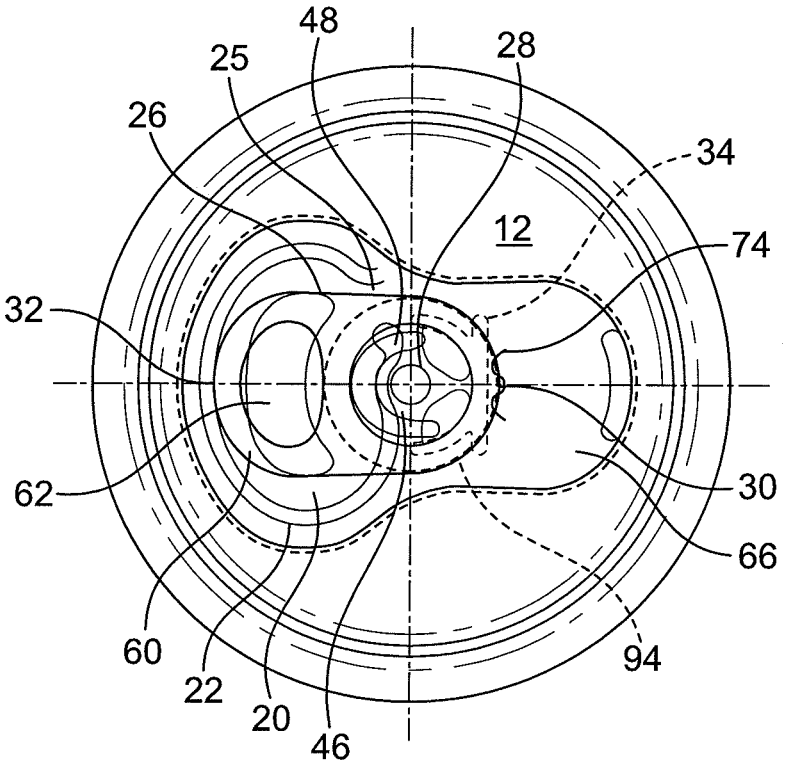
FIG. 2 is a top view of the can end of FIG. 1 showing a tab rotated 180 degrees from a first frangible score breaking position to a second frangible score breaking position.
Figure 3:
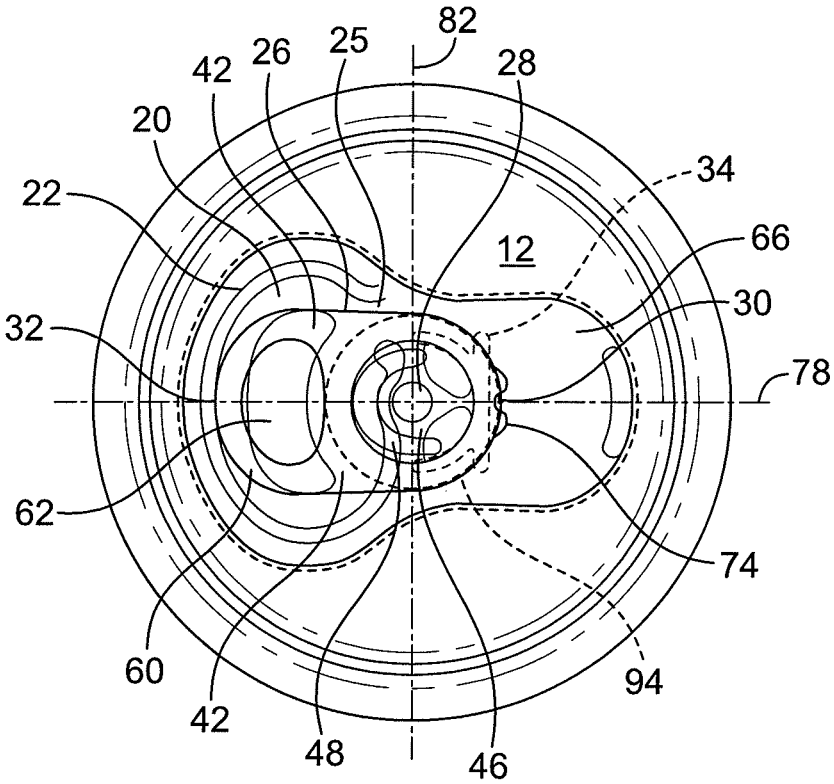
FIG. 3 is a top view of a can end of the present invention showing a curvilinear score acting as a means for providing a pressure equalization port when severed or fractured.
Figure 4:
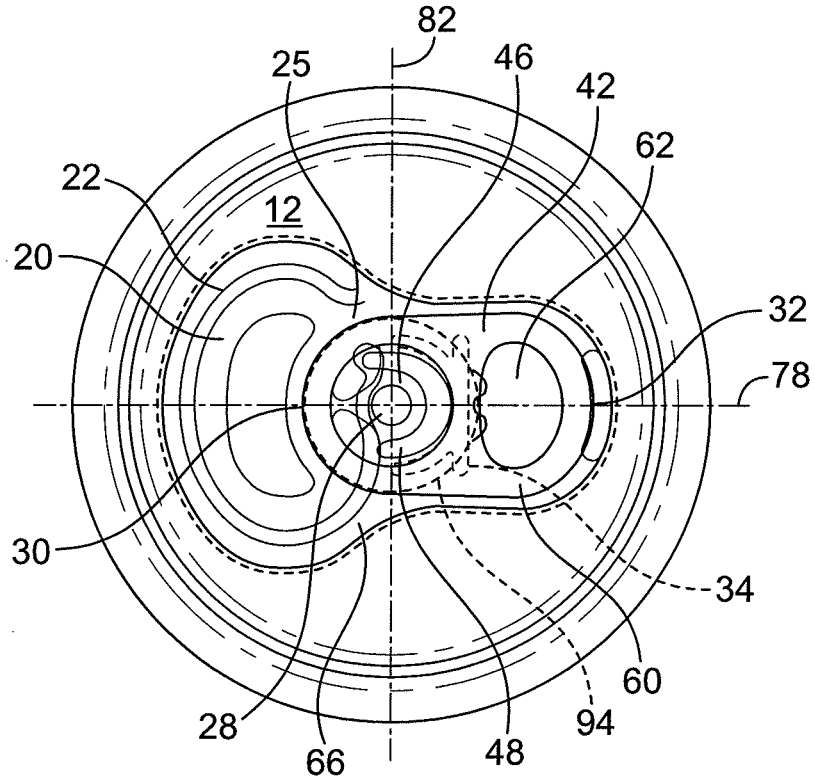
FIG. 4 is a top view of the can end of FIG. 3 showing a tab rotated 180 degrees from a first frangible score breaking position to a second frangible score breaking position.
Figure 8:
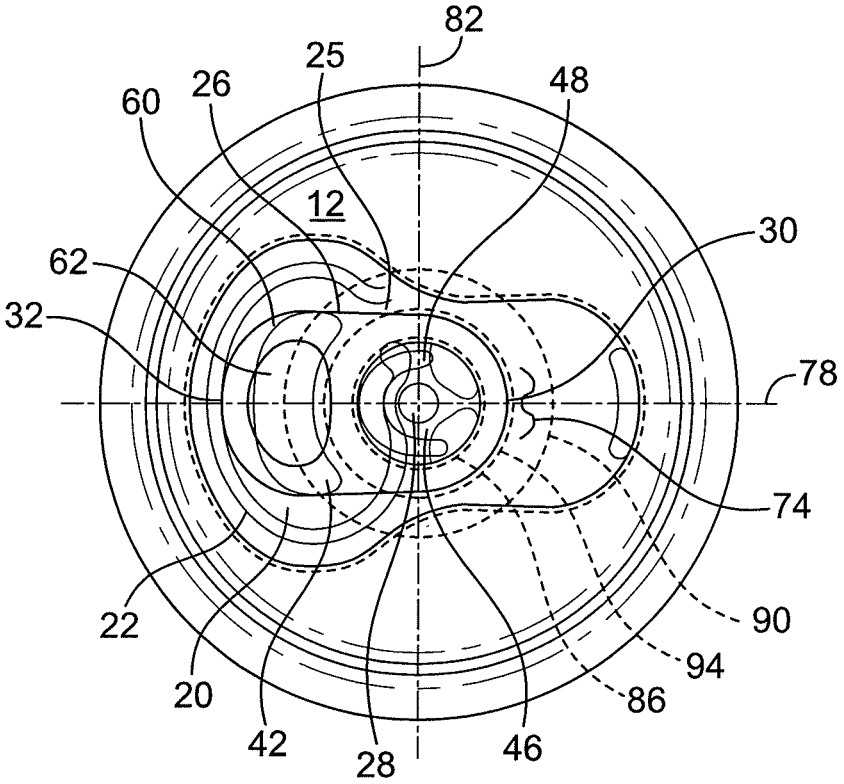
FIG. 8 is a top view of the can end of FIG. 7 showing a tab rotated 180 degrees from a first frangible score breaking position to a second frangible score breaking position.
Figure 9:
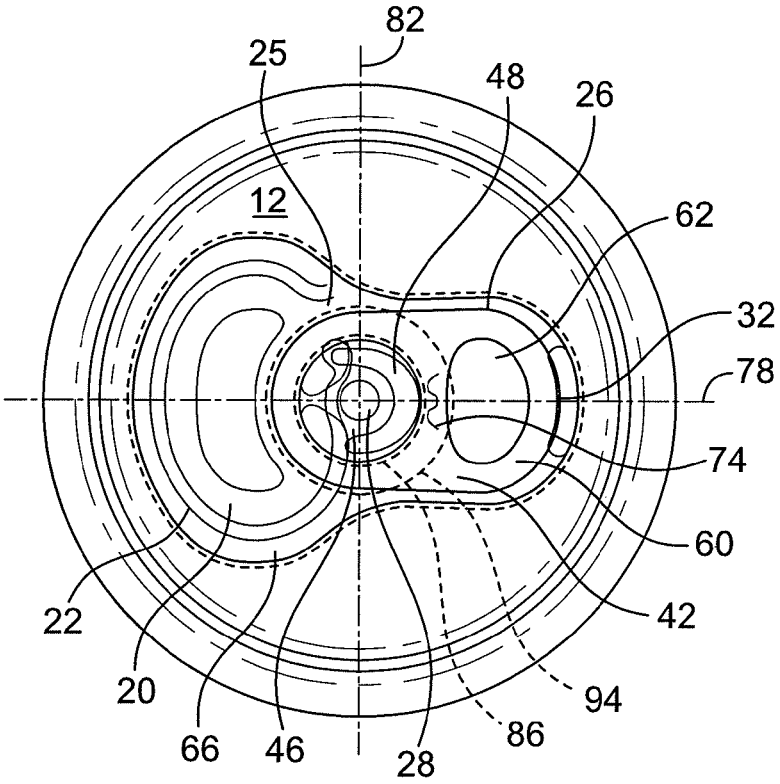
FIG. 9 is a top view of a can end of the present invention showing a curvilinear score acting as a means for providing a pressure equalization port when severed or fractured.
Figure 10:
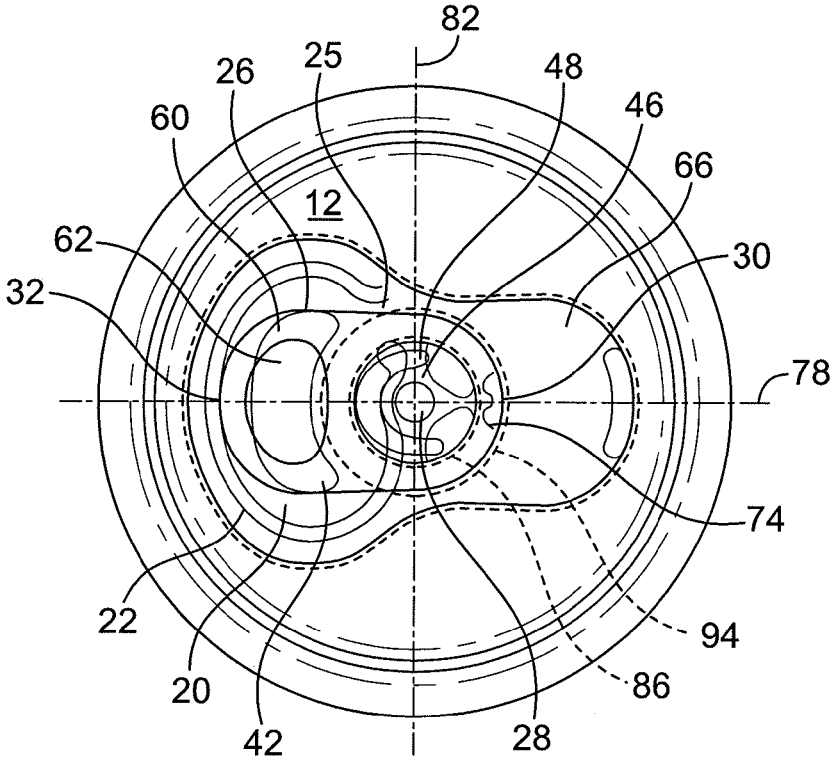
FIG. 10 is a top view of the can end of FIG. 9 showing a tab rotated 180 degrees from a first frangible score breaking position to a second frangible score breaking position.
Figure 11:
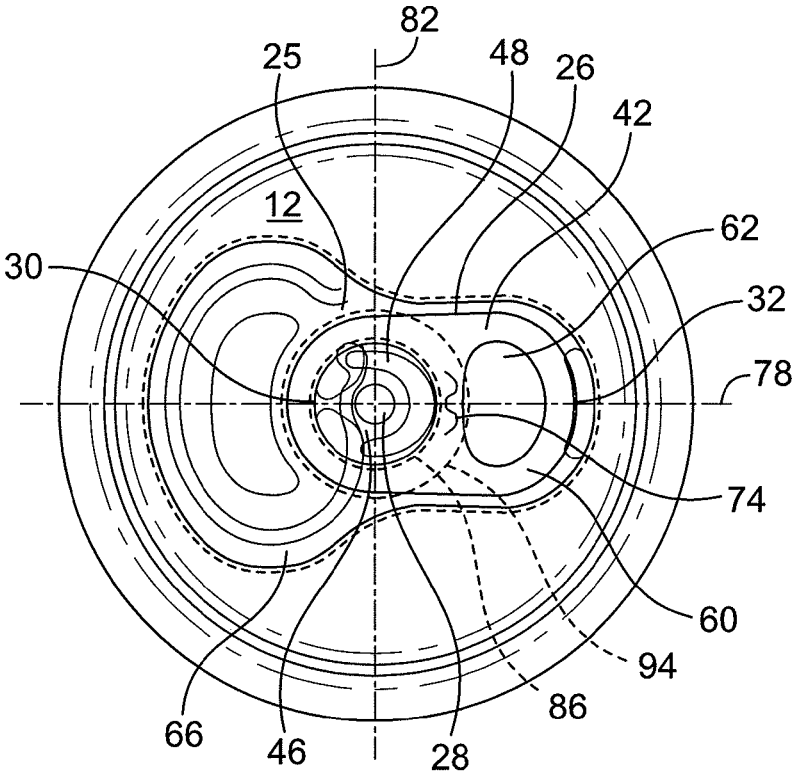
FIG. 11 is a top view of a can end of the present invention showing a curvilinear score acting as a means for providing a pressure equalization port when severed or fractured.
Figure 12:
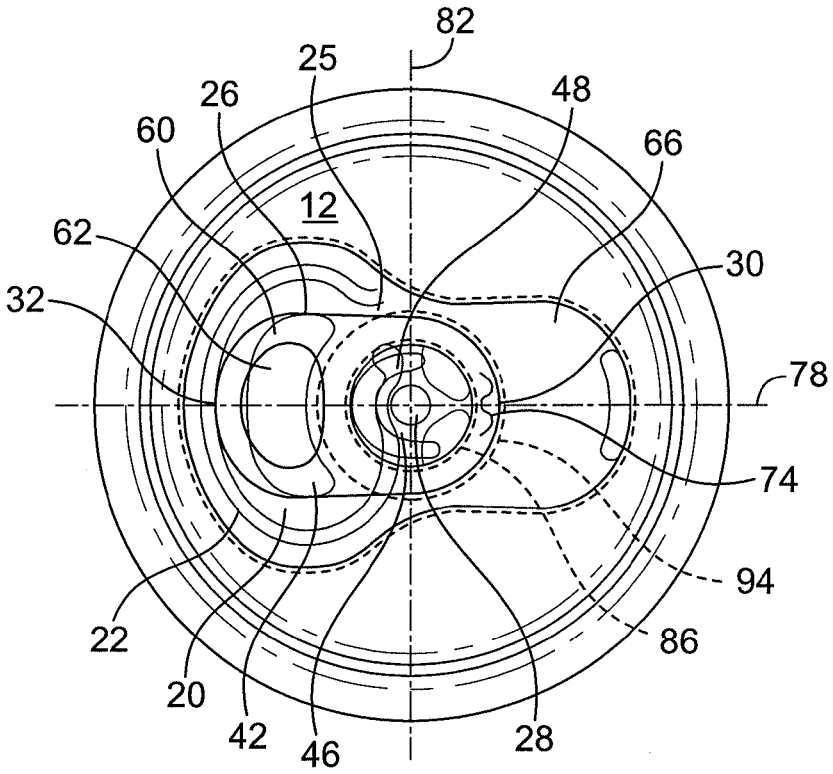
FIG. 12 is a top view of the can end of FIG. 11 showing a tab rotated 180 degrees from a first frangible score breaking position to a second frangible score breaking position.

A third radial distance 94 has a length from the center of the rivet 28 greater than the length of the first radial distance 86 and less than the length of the second radial distance 90. The third radial distance 94 is equal to a maximum length from the center of the rivet 28 to the nose end 30 of the tab 26. Accordingly, the can end 10 has a third circle having a radius equal to the third radial distance 94. The frangible score 74 may be located between and/or spaced from the second circle and the third circle, may be located between and/or spaced from the first and third circles. Alternatively, the frangible score 74 may intersect the third circle. In one embodiment, the tab nose 30 is rotatable about the rivet 28 180 degrees from the tear panel 20 breaking position such that the tab nose 26 overlies frangible score 74 in a frangible score 74 breaking position (see, e.g., FIGS. 2, 4, and 14). In another embodiment, the tab nose 30 is rotatable about the rivet 180 degrees from the tear panel 20 breaking position such that the first axis 78 bisects the tab nose 30, and the tab nose 30 is located radially inwardly of the frangible score 74 (see, e.g., FIGS. 6 and 8). In another embodiment, the tab nose 30 is rotatable about the rivet 180 degrees from the tear panel 20 breaking position such that the first axis 78 bisects the tab nose 30, and the tab nose 30 is located radially outwardly of the frangible score 74 (see, e.g., FIGS. 10 and 12).

The frangible score 74 is generally located completely within the deboss panel 66. For example, the tab 26 has a perimeter defining a tab area therebetween, and the frangible score 74 may be located within a region of the center panel 12 under the tab area when the tab 26 is in the tear panel 20 breaking position, preferably located entirely within the region of the center panel 12 under the tab area when the tab 26 is in the tear panel 20 breaking position. In one embodiment, the first axis 78 bisects the frangible score 74. In one embodiment, the frangible score 74 is visible through the finger hole 62. The raised bead 34 is located between and is spaced from the coined region surrounding the rivet 28 and the frangible score 74.

The shape of the frangible score 74 is generally curvilinear, preferably having a pair of concave portions 98 separated by a convex portion 102, all located between opposing terminal ends 110. This shape creates a pressure equalization port defined in part by a plurality of hinge portions. In this case, these hinge portions may be bends, deflections, recesses, or the like created by mere fracture of the frangible score 74 using the tab 26.

One hinge portion 114*a* extends from a terminal end 110 to an apex of the convex portion 102; another hinge portion 114*b* extends from the opposing terminal end 110 to the convex portion 102. Another hinge portion 114*c* may extend between apex portions of the concave portions 98. The determining factor in how many hinge portions are employed is generally determined by the location of the tab nose 30 relative to the position of the frangible score 74 during breaking of the frangible score 74 to open the pressure equalization port. In one embodiment, an opened pressure equalization port 120 is defined by an edge portion of a broken frangible score and a plurality of hinge portions 114*a*,114*b* located between terminal ends 110 of the frangible score 74 and opposite the edge portion. Alternatively, an opened pressure equalization port 120 is defined by a hinge portion 114*c* located opposite a pair of hinge potions 114*a,b* wherein a first hinge portion 114*c* is separated from a second hinge portion 114*a* by a first terminal end 110, and the first hinge portion 114*c* is separated from a third hinge portion 114*b* by a second terminal end 110, an opening being defined therebetween.

In one embodiment, the frangible score 74 is spaced completely radially outwardly from the rivet island 46 and is intersected by the first axis 78 and opposing terminal ends 110 of the frangible score 74 are located on opposing sides of the first axis. A length of the frangible score 74 between the terminal ends 110 is greater than a distance between a radially outermost portion of the frangible score 74 to a radially innermost portion of the second frangible score. Stated another way, a length of the frangible score 74 in a direction generally common with, or parallel to, the second axis 82 is greater than a length of the frangible score 74 in a direction generally common with, or parallel to, the first axis 78. Stated yet another way, a height of the frangible score 74 is less than a width of the frangible score 74.

The terms "first," "second," "upper," "lower," "top," "bottom," etc. are used for illustrative purposes relative to other elements only and are not intended to limit the embodiments in any way. The term "plurality" as used herein is intended to indicate any number greater than one, either disjunctively or conjunctively as necessary, up to an infinite number. The terms "joined," "attached," and "connected" as used herein are intended to put or bring two elements together so as to form a unit, and any number of elements, devices, fasteners, etc. may be provided between the joined or connected elements unless otherwise specified by the use of the term "directly" and/or supported by the drawings.

While the specific embodiments have been illustrated and described, numerous modifications come to mind without significantly departing from the spirit of the invention, and the scope of protection is only limited by the scope of the accompanying Claims.

What is claimed is:

1. A can end for a beverage container comprising:

a circumferential curl centered about a longitudinal axis;

a circumferential wall extending downwardly relative to the curl;

a circumferential strengthening member extending downwardly relative to the circumferential wall;

a center panel about which the circumferential strengthening member extends having a public side opposite a product side, the center panel comprising:

a peripheral edge defining a radially outer perimeter of the center panel;

a tear panel spaced radially inwardly from the peripheral edge, the tear panel defined by a first frangible score in the public side and non-frangible hinge segment;

a tab comprising:

a lift end;

a nose end opposite the lift end and overlying the tear panel in a first frangible score breaking position;

a rivet island having a rivet aperture;

a void region partially surrounding the rivet island having a first leg extending along a first side of the rivet island and a second leg extending along a second side of the rivet island; and a tab hinge extending between respective terminal ends of the first and second legs of the void region;

a rivet attaching the tab to the center panel spaced from the tear panel;

a coined portion of the center panel surrounding the rivet;

a first axis extending through the nose end and lift end of the tab and through a center of the rivet;

a second axis perpendicular to the first axis;

a first circle having a first center point located at the center of the rivet and a first radius equal to a distance from the center of the rivet to a radially outermost point of the void region on the first axis;

a second circle having a second center point located at the center of the rivet and a second radius less than 2.5 times first radius; and a second frangible score spaced completely radially outwardly from the rivet island and between the first circle and the second circle such that no portion of the second circle intersects the frangible score.

2. The can end of claim 1 further comprising:

a third circle having a third radius equal to a maximum length from the center of the rivet to the nose end of the tab wherein the second frangible score intersects the third circle.

3. The can end of claim 1 further comprising:

a third circle having a third radius equal to a maximum length from the center of the rivet to the nose end of the tab wherein the second frangible score is located between and spaced from the second circle and the third circle.

4. The can end of claim 1 further comprising:

a third circle having a third radius equal to a maximum length from the center of the rivet to the nose end of the tab wherein the second frangible score is located between the first circle and the third circle.

5. The can end of claim 4 wherein the second frangible score is spaced from the first circle and the third circle.

6. The can end of claim 1 wherein the tab has a perimeter defining a tab area therebetween and the second frangible score is located within a region of the center panel under the tab area when the tab is in the first frangible score breaking position.

7. The can end of claim 1 wherein the tab has a peripheral edge defining a tab area and the second frangible score is located entirely within a region of the center panel under the tab area when the tab is in the first frangible score breaking position.

8. The can end of claim 1 wherein the tab nose is rotatable about the rivet 180 degrees from the first frangible score breaking position such that the tab nose overlies the second frangible score.

9. The can end of claim 1 wherein the tab nose is rotatable about the rivet 180 degrees from the first frangible score breaking position such that the first axis bisects the tab nose and the tab nose is located radially inwardly of the second frangible score.

10. The can end of claim 1 wherein the tab nose is rotatable about the rivet 180 degrees from the first frangible score breaking position such that the first axis bisects the tab nose and the tab nose is located radially outwardly of the second frangible score.

11. The can end of claim 1 wherein the first axis bisects the second frangible score.

12. The can end of claim 1 wherein the second frangible score has a curvilinear shape having a pair of concave portions between opposing terminal ends and separated by a convex portion relative to each other.

13. The can end of claim 1 wherein the tab further comprising a second void region defining a finger hole and wherein the second frangible score is visible through the finger hole.

14. The can end of claim 1 wherein the first and second axes lie along diametrical lines on the center panel.

15. The can end of claim 1 further comprising:

a deboss panel recessed within the center panel wherein the tab and the first and second frangible scores are located entirely within the deboss panel.

16. The can end of claim 1 further comprising:

an upwardly extending bead of the center panel partially surrounding the coined portion surrounding the rivet located between the second frangible score and the rivet.

17. A can end for a beverage container comprising:

a circumferential curl centered about a longitudinal axis;

a circumferential wall extending downwardly relative to the curl;

a circumferential strengthening member extending radially inwardly relative from the circumferential wall;

a center panel about which the circumferential strengthening member extends having a public side opposite a product side, the center panel comprising:

a peripheral edge defining a radially outer perimeter of the center panel;

a tear panel spaced radially inwardly from the peripheral edge, the tear panel defined by a first frangible score in the public side and non-frangible hinge segment;

a tab comprising:

a lift end;

a nose end opposite the lift end and overlying the tear panel in a first frangible score breaking position;

a rivet island having a rivet aperture;

a void region partially surrounding the rivet island having a first leg extending along a first side of the rivet island and a second leg extending along a second side of the rivet island; and a tab hinge extending between respective terminal ends of the first and second legs of the void region;

a rivet attaching the tab to the center panel spaced from the tear panel;

a coined portion of the center panel surrounding the rivet;

a first axis extending through the nose end and lift end of the tab and through a center of the rivet; and a second axis perpendicular to the first axis; and a selectively openable pressure equalization port spaced completely radially outwardly from the rivet island and defined by an area of the center panel located between an edge portion of a broken second frangible score and a plurality of hinge portions located between terminal ends of the second frangible score.

18. The can end of claim 17 further comprising:

a first circle having a first center point located at a center of the rivet and a first radius equal to a distance from the center of the rivet to a radially outermost point of the void region on the first axis; and a second circle having a second center point located at the center of the rivet and a second radius less than 2.5 times first radius, wherein the second frangible score is located between the first circle and the second circle.

19. The can end of claim 17 further comprising:

a third circle having a third radius equal to a maximum length from a center of the rivet to the nose end of the tab wherein the second frangible score intersects the third circle.

20. The can end of claim 18 further comprising:

a third circle having a third radius equal to a maximum length from a center of the rivet to the nose end of the tab wherein the second frangible score is located between and spaced from the second circle and the third circle.

21. The can end of claim 18 further comprising:

a third circle having a third radius equal to a maximum length from a center of the rivet to the nose end of the tab wherein the second frangible score is located between the first circle and the third circle.

22. The can end of claim 21 wherein the second frangible score is spaced from the first circle and the second circle.

23. The can end of claim 17 wherein the tab has a perimeter defining a tab area therebetween and the second frangible score is located within a region of the center panel under the tab area when the tab is in the first frangible score breaking position.

24. The can end of claim 17 wherein the tab has a peripheral edge defining a tab area and the second frangible score is located entirely within a region of the center panel under the tab area when the tab is in the first frangible score breaking position.

25. The can end of claim 17 wherein the tab nose is rotatable about the rivet 180 degrees from the first frangible score breaking position such that the tab nose overlies the second frangible score.

26. The can end of claim 17 wherein the tab nose is rotatable about the rivet 180 degrees from the first frangible score breaking position such that the first axis bisects the tab nose and the tab nose is located radially inwardly of the second frangible score.

27. The can end of claim 17 wherein the tab nose is rotatable about the rivet 180 degrees from the first frangible score breaking position such that the first axis bisects the tab nose and the tab nose is located radially outwardly of the second frangible score.

28. The can end of claim 17 wherein the first axis bisects the second frangible score.

29. The can end of claim 17 wherein the second frangible score has a curvilinear shape having a pair of concave portions between opposing terminal ends and separated by a convex portion relative to each other.

30. The can end of claim 17 wherein the tab further comprising a second void region defining a finger hole and wherein the second frangible score is visible through the finger hole.

31. The can end of claim 17 wherein the first and second axes lie along diametrical lines on the center panel.

32. The can end of claim 17 further comprising:

a deboss panel recessed within the center panel wherein the tab and the first and second frangible scores are located entirely within the deboss panel.

33. The can end of claim 17 further comprising:

an upwardly extending bead of the center panel partially surrounding the coined portion surrounding the rivet located between the second frangible score and the rivet.

34. A can end for a beverage container comprising:

a circumferential curl centered about a longitudinal axis;

a circumferential wall extending downwardly relative to the curl;

a circumferential strengthening member extending downwardly relative to the circumferential wall;

a center panel about which the circumferential strengthening member extends having a public side opposite a product side, the center panel comprising:

a peripheral edge defining a radially outer perimeter of the center panel;

a tear panel spaced radially inwardly from the peripheral edge, the tear panel defined by a first frangible score in the public side and non-frangible hinge segment;

a tab comprising:

a lift end;

a nose end opposite the lift end and overlying the tear panel in a first frangible score breaking position;

a rivet island having a rivet aperture;

a void region partially surrounding the rivet island having a first leg extending along a first side of the rivet island and a second leg extending along a second side of the rivet island;

a tab hinge extending between respective terminal ends of the first and second legs of the void region; and a second void region defining a finger hole;

a rivet attaching the tab to the center panel spaced from the tear panel;

a coined portion of the center panel surrounding the rivet;

a first axis extending through the nose end and lift end of the tab and through a center of the rivet;

a second axis perpendicular to the first axis;

a first circle having a first center point located at the center of the rivet and a first radius equal to a distance from the center of the rivet to a radially outermost point of the void region on the first axis;

a second circle having a second center point located at the center of the rivet and a second radius less than 2.5 times first radius; and a second frangible score spaced completely radially outwardly from the rivet island and between the first circle and the second circle, wherein the second frangible score is visible through the finger hole.

35. A can end for a beverage container comprising:

a circumferential curl centered about a longitudinal axis;

a circumferential wall extending downwardly relative to the curl;

a circumferential strengthening member extending downwardly relative to the circumferential wall;

a center panel about which the circumferential strengthening member extends having a public side opposite a product side, the center panel comprising:

a peripheral edge defining a radially outer perimeter of the center panel;

a tear panel spaced radially inwardly from the peripheral edge, the tear panel defined by a first frangible score in the public side and non-frangible hinge segment;

a tab comprising:

a lift end;

a nose end opposite the lift end and overlying the tear panel in a first frangible score breaking position;

a rivet island having a rivet aperture;

a void region partially surrounding the rivet island having a first leg extending along a first side of the rivet island and a second leg extending along a second side of the rivet island; and a tab hinge extending between respective terminal ends of the first and second legs of the void region;

a rivet attaching the tab to the center panel spaced from the tear panel;

a coined portion of the center panel surrounding the rivet;

a first axis extending through the nose end and lift end of the tab and through a center of the rivet;

a second axis perpendicular to the first axis;

a first circle having a first center point located at the center of the rivet and a first radius equal to a distance from the center of the rivet to a radially outermost point of the void region on the first axis;

a second circle having a second center point located at the center of the rivet and a second radius less than 2.5 times first radius;

a second frangible score spaced completely radially outwardly from the rivet island and between the first circle and the second circle; and an upwardly extending bead of the center panel partially surrounding the coined portion surrounding the rivet located between the second frangible score and the rivet.

* * * * *